US010696516B2

(12) United States Patent
Taniyama

(10) Patent No.: US 10,696,516 B2
(45) Date of Patent: Jun. 30, 2020

(54) ELEVATOR GROUP MANAGEMENT SYSTEM

(71) Applicant: Mitsubishi Electric Corporation, Chiyoda-ku (JP)

(72) Inventor: Kenji Taniyama, Tokyo (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 430 days.

(21) Appl. No.: 15/549,437

(22) PCT Filed: Mar. 26, 2015

(86) PCT No.: PCT/JP2015/059432
§ 371 (c)(1),
(2) Date: Aug. 8, 2017

(87) PCT Pub. No.: WO2016/151853
PCT Pub. Date: Sep. 29, 2016

(65) Prior Publication Data
US 2018/0022572 A1 Jan. 25, 2018

(51) Int. Cl.
*B66B 1/18* (2006.01)
*B66B 1/16* (2006.01)
(Continued)

(52) U.S. Cl.
CPC ..... *B66B 1/18* (2013.01); *B66B 1/16* (2013.01); *B66B 1/2458* (2013.01); *B66B 1/468* (2013.01);
(Continued)

(58) Field of Classification Search
CPC ..... B66B 1/18; B66B 1/16; B66B 1/2458; B66B 1/468; B66B 3/006; B66B 3/02; B66B 2201/104; B66B 2201/4661
(Continued)

(56) References Cited

U.S. PATENT DOCUMENTS 9,682,843 B2 * 6/2017 Nakagawa ..... B66B 1/2458
2010/0282543 A1 * 11/2010 Hsu ..... B66B 1/2433 187/247

(Continued)

FOREIGN PATENT DOCUMENTS

CN 101108707 A 1/2008
EP 2216283 A1 8/2010

(Continued)

OTHER PUBLICATIONS

Chinese Office Action dated May 22, 2019 in Patent Application No. 201580077876.9 (with English translation), 9 pages.

(Continued)

*Primary Examiner* — David S Warren

(74) *Attorney, Agent, or Firm* — Oblon, McClelland, Maier & Neustadt, L.L.P.

(57) ABSTRACT

An elevator group management system includes: a hall call registration device which is provided at a first hall; a hall destination call registration device which is provided at a second hall; a notification device which is provided at the first hall; an assigned car display device which is provided at the second hall; and a group management control device which selects a priority car from among a plurality of cars. When a priority car is selected, the group management control device performs, with respect to a hall call to which the priority car is already assigned, hall call control which differs from control with respect to a hall destination call to which the priority car is already assigned.

6 Claims, 5 Drawing Sheets

(51) Int. Cl.

| | |
|---|---|
| ***B66B 1/24*** | (2006.01) |
| ***B66B 3/00*** | (2006.01) |
| ***B66B 1/46*** | (2006.01) |
| ***B66B 3/02*** | (2006.01) |

(52) U.S. Cl.
CPC ..... *B66B 3/006* (2013.01); *B66B 3/02* (2013.01); *B66B 2201/104* (2013.01); *B66B 2201/4661* (2013.01)

(58) Field of Classification Search
USPC ..... 187/247
See application file for complete search history.

(56) References Cited

U.S. PATENT DOCUMENTS

| | | | | |
|---|---|---|---|---|
| 2015/0090535 | A1* | 4/2015 | Nakagawa | B66B 1/2458 187/387 |
| 2016/0122156 | A1* | 5/2016 | Kondo | B66B 5/0031 187/247 |
| 2017/0313547 | A1* | 11/2017 | Lefevre | B66B 5/021 |
| 2018/0022572 | A1* | 1/2018 | Taniyama | B66B 1/16 187/247 |
| 2018/0044138 | A1* | 2/2018 | Roberts | B66B 1/2491 |

FOREIGN PATENT DOCUMENTS

| | | | |
|---|---|---|---|
| JP | 58-22276 | A | 2/1983 |
| JP | 63-24907 | B2 | 5/1988 |
| JP | 10-53377 | A | 2/1998 |
| JP | 2798923 | B2 | 9/1998 |
| JP | 2013-67497 | A | 4/2013 |
| JP | 2013-184772 | A | 9/2013 |
| WO | 2009/072214 | A1 | 6/2009 |

OTHER PUBLICATIONS

Japanese Office Action dated Dec. 5, 2017 in Japanese Patent Application No. 2017-507292 (with English translation).
Combined Office Action and Search Report dated Oct. 12, 2018 in Chinese Patent Application No. 201580077876.9, 16 pages (with unedited computer generated English translation).
International Search Report dated Jun. 30, 2015, in PCT/JP2015/059432, filed Mar. 26, 2015.

* cited by examiner

FIG. 5

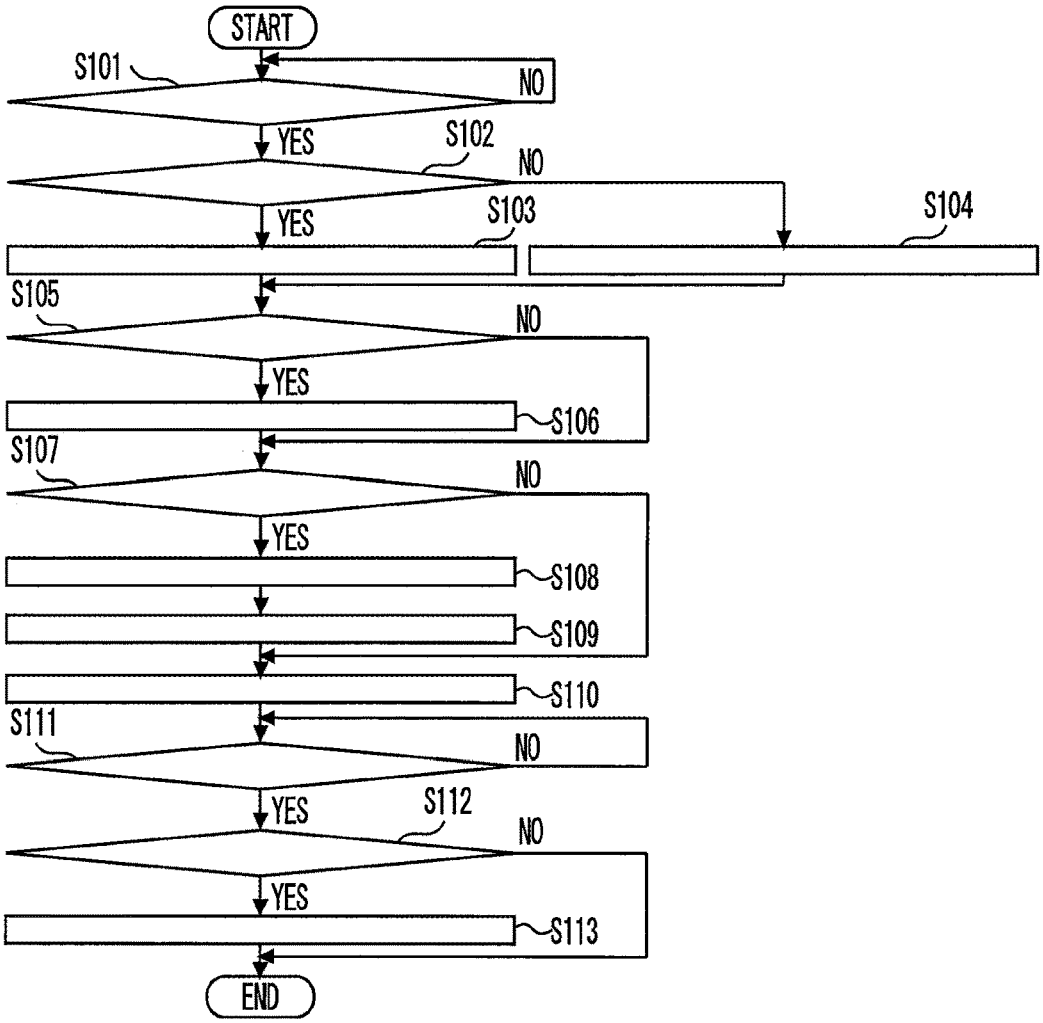

S101:IS THERE PRIORITY OPERATION REQUEST?
S102:ARE THERE CARS NOT ALREADY ASSIGNED TO HALL CALLS WITH PRIORITY OPERATION STANDBY FLOOR AS BOARDING FLOOR?
S103:SELECT PRIORITY CAR FROM AMONG CARS NOT ALREADY ASSIGNED TO HALL CALLS WITH PRIORITY OPERATION STANDBY FLOOR AS BOARDING FLOOR
S104:SELECT PRIORITY CAR FROM AMONG ALL CARS
S105:IS THERE HALL DIRECTION CALL TO WHICH PRIORITY CAR IS ALREADY ASSIGNED?
S106:ALLOCATE ANOTHER CAR TO HALL DIRECTION CALL TO WHICH PRIORITY CAR IS ALREADY ASSIGNED
S107:IS THERE HALL DESTINATION CALL TO WHICH PRIORITY CAR IS ALREADY ASSIGNED?
S108:STORE HALL DESTINATION CALL TO WHICH PRIORITY CAR IS ALREADY ASSIGNED
S109:CANCEL HALL DESTINATION CALL TO WHICH PRIORITY CAR IS ALREADY ASSIGNED
S110:START PRIORITY OPERATION
S111:PRIORITY OPERATION COMPLETED?
S112:IS THERE STORED HALL DESTINATION CALL?
S113:REALLOCATE PRIORITY CAR TO STORED HALL DESTINATION CALL AND DELETE STORED HALL DESTINATION CALL

ELEVATOR GROUP MANAGEMENT SYSTEM

TECHNICAL FIELD

The present invention relates to an elevator group management system.

BACKGROUND ART

PTL1 described below discloses an elevator group management system. With the described elevator group management system, when a priority operation for a specific user is performed, a priority car to be used in the priority operation is selected from among a plurality of cars.

CITATION LIST

Patent Literature

[PTL 1] Japanese Patent Application Laid-open No. 2013-184772

SUMMARY OF INVENTION

Technical Problem

With the elevator group management system according to PTL 1, when a car already being assigned to a hall call registered by a general user is selected as a priority car, convenience of the general user declines.

The present invention has been made in order to solve the problem described above. An object of the present invention is to provide an elevator group management system capable of suppressing a decline in convenience of general users caused by performing a priority operation.

Solution to Problem

An elevator group management system according to the present invention includes: a hall call registration device which is provided at a first hall for getting onto or getting off a plurality of cars that travel through different elevation paths and which is used to register hall calls; a hall destination call registration device which is provided at a second hall for getting onto or getting off the plurality of cars and which is used to register a hall destination call among the hall calls; a notification device which is provided at the first hall and which indicates an elevation path through which a car currently being assigned to a hall call registered using the hall call registration device travels; an assigned car display device which is provided at the second hall and which displays, when a hall destination call is registered using the hall destination call registration device, an elevation path through which a car having been assigned to the hall destination call travels, only for a given length of time; and a group management control device which assigns one of the plurality of cars to a hall call registered using the hall call registration device and the hall destination call registration device and which selects a priority car to be used in a priority operation from among the plurality of cars, wherein when a priority car is selected from among the plurality of cars, the group management control device assigns a car that differs from the priority car to a hall call which is registered using the hall call registration device and to which the priority car is already assigned, and performs the priority operation using the priority car and subsequently causes the priority car to respond to a hall destination call which is registered using the hall destination call registration device and to which the priority car is already assigned.

Advantageous Effects of Invention

In the elevator group management system according to the present invention, when a priority car is selected from among a plurality of cars, the group management control device assigns a car that differs from the priority car to a hall call which is registered using the hall call registration device and to which the priority car is already assigned, and performs a priority operation using the priority car and subsequently causes the priority car to respond to a hall destination call which is registered using the hall destination call registration device and to which the priority car is already assigned. As a result, according to the present invention, a decline in convenience of general users caused by performing the priority operation can be suppressed.

BRIEF DESCRIPTION OF DRAWINGS

FIG. 5 is a flowchart showing operations of the elevator group management system according to Embodiment 1 of the present invention.

DESCRIPTION OF EMBODIMENTS

Figure 1:
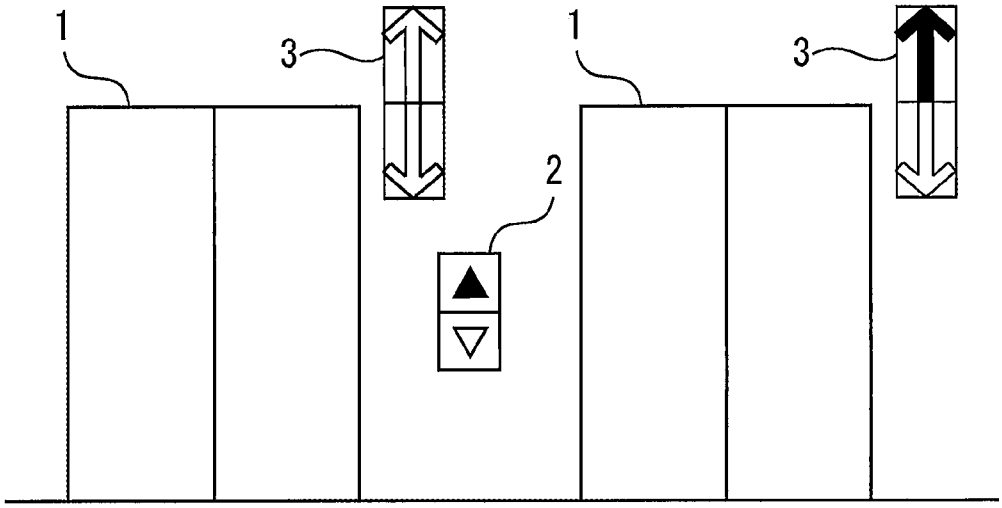
FIG. 1 is a front view showing a first hall provided in a building to which an elevator group management system according to Embodiment 1 of the present invention is applied.

The present invention will be described in detail with reference to the accompanying drawings. In the respective drawings, same or corresponding portions are assigned same reference numerals. Redundant descriptions will be simplified or omitted as appropriate.

Embodiment 1

An elevator group management system according to Embodiment 1 is applied to a building (not shown) including a plurality of floors. For example, an elevator hall is provided on each floor of the building. The building is provided with a plurality of cars which travel through different elevation paths.

Figure 2:
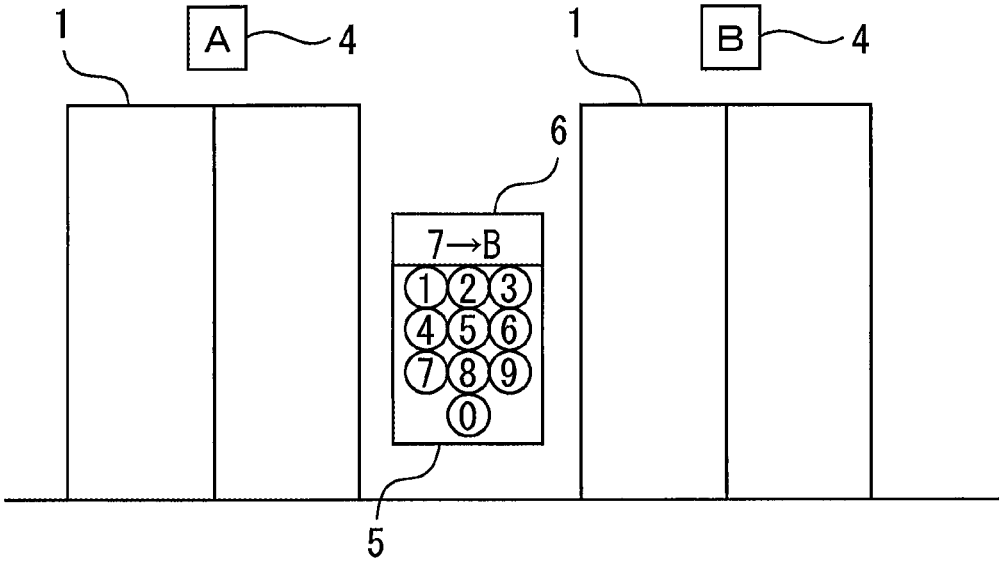
FIG. 2 is a front view showing a second hall provided in a building to which the elevator group management system according to Embodiment 1 of the present invention is applied.

FIG. 1 is a front view showing a first hall provided in the building to which the elevator group management system according to Embodiment 1 is applied. FIG. 2 is a front view showing a second hall provided in the building to which the elevator group management system according to Embodiment 1 is applied. The second hall is provided on a floor which differs from that of the first hall in the same building.

As shown in FIGS. 1 and 2, a plurality of hall doors 1 are provided at an elevator hall. FIGS. 1 and 2 show, as an example, a case where two hall doors 1 are provided at each hall. Although not shown, an elevation path through which a car travels exists beyond each hall door 1. The elevation path is, for example, a hoistway formed so as to penetrate the respective floors of the building. A first elevation path exists beyond a left-side hall door 1 in FIG. 1 and a left-side hall door 1 in FIG. 2. A second elevation path exists beyond a right-side hall door 1 in FIG. 1 and a right-side hall door 1 in FIG. 2. Hereinafter, a car which travels through the first elevation path will be referred to as a "car A" and a car which travels through the second elevation path will be referred to as a "car B". In other words, the first hall is a hall for getting onto or getting off the car A or the car B which travels through a different elevation path. The second hall is a hall for getting onto or getting off the car A or the car B on a different floor from the floor of the first hall.

A hall call registration device is provided at the first hall. The hall call registration device is to be operated by a user of the elevator or the like in order to register a hall call. FIG. 1 shows a case where a hall direction call registration device 2 is provided as the hall call registration device. The hall direction call registration device 2 is used to register a hall direction call among the hall calls. A hall direction call is a hall call which only specifies a direction of a destination.

The hall direction call registration device 2 includes, for example, an up button which corresponds to upward, a down button which corresponds to downward, and the like. For example, a user presses the up button of the hall direction call registration device 2 in order to register an upward hall direction call. For example, a user presses the down button of the hall direction call registration device 2 in order to register a downward hall direction call. FIG. 1 shows a state where the up button of the hall direction call registration device 2 is pressed.

A notification device is provided at the first hall. The notification device indicates an elevation path through which a car currently being assigned to a hall call registered using the hall call registration device travels. FIG. 1 shows a case where an arrival forecast device 3 is provided as the notification device. The arrival forecast device 3 indicates a next car to stop at the floor on which the first hall is provided and a travel direction of the car. In other words, the arrival forecast device 3 notifies a car currently being assigned to a hall direction call.

The arrival forecast device 3 includes, for example, an upward display lamp which corresponds to upward, a downward display lamp which corresponds to downward, and the like. The arrival forecast device 3 gives notification by, for example, lighting or blinking the display lamps. For example, the arrival forecast device 3 is provided on a wall or the like near an upper end of the hall door 1. The arrival forecast device 3 is provided in correspondence with each hall door 1. In other words, the arrival forecast device 3 is provided in correspondence with each elevation path and each car. For example, when the car B arrives in response to an upward hall direction call, as shown in FIG. 1, the upward display lamp corresponding to the hall door 1 for getting onto and getting off the car B is lighted.

As shown in FIG. 2, a car name display 4 is provided at the second hall. For example, the car name display 4 is provided on a wall or the like near an upper end of the hall door 1. The car name display 4 is provided in correspondence with each hall door 1. In other words, the car name display 4 is provided in correspondence with each elevation path and each car. The car name display 4 displays characters, symbols, and the like which indicate a corresponding car. For example, as shown in FIG. 2, a left-side car name display 4 corresponding to the car A displays "A". For example, a right-side car name display 4 corresponding to the car B displays "B".

As shown in FIG. 2, a hall destination call registration device 5 is provided at the second hall. The hall destination call registration device 5 is to be operated by a user or the like in order to register a hall destination call among the hall calls. A hall destination call is a hall call which specifies a destination floor.

The hall destination call registration device 5 includes, for example, buttons respectively corresponding to numerals 0 to 9 and the like. For example, a user presses the "7" button of the hall destination call registration device 5 in order to register a hall destination call of which the destination floor is the 7th floor.

As shown in FIG. 2, an assigned car display device 6 is provided at the second hall. When a destination floor is input using the hall destination call registration device 5, the assigned car display device 6 displays, only for a given length of time, information indicating the destination floor and a car to be used to travel to the destination floor. In other words, when a hall destination call is registered using the hall destination call registration device 5, the assigned car display device 6 displays, only for a given length of time, an elevation path through which a car having been assigned to the hall destination call travels.

For example, the assigned car display device 6 is arranged near the hall destination call registration device 5. Information indicating a car which is displayed by the assigned car display device 6 corresponds to, for example, the characters, symbols, and the like which are displayed by the car name display 4. FIG. 2 shows an example of a case where the car B is assigned to a hall destination call of which the destination floor is the 7th floor. Alternatively, for example, the assigned car display device 6 may be formed as a device integrated with the hall destination call registration device 5.

Figure 3:
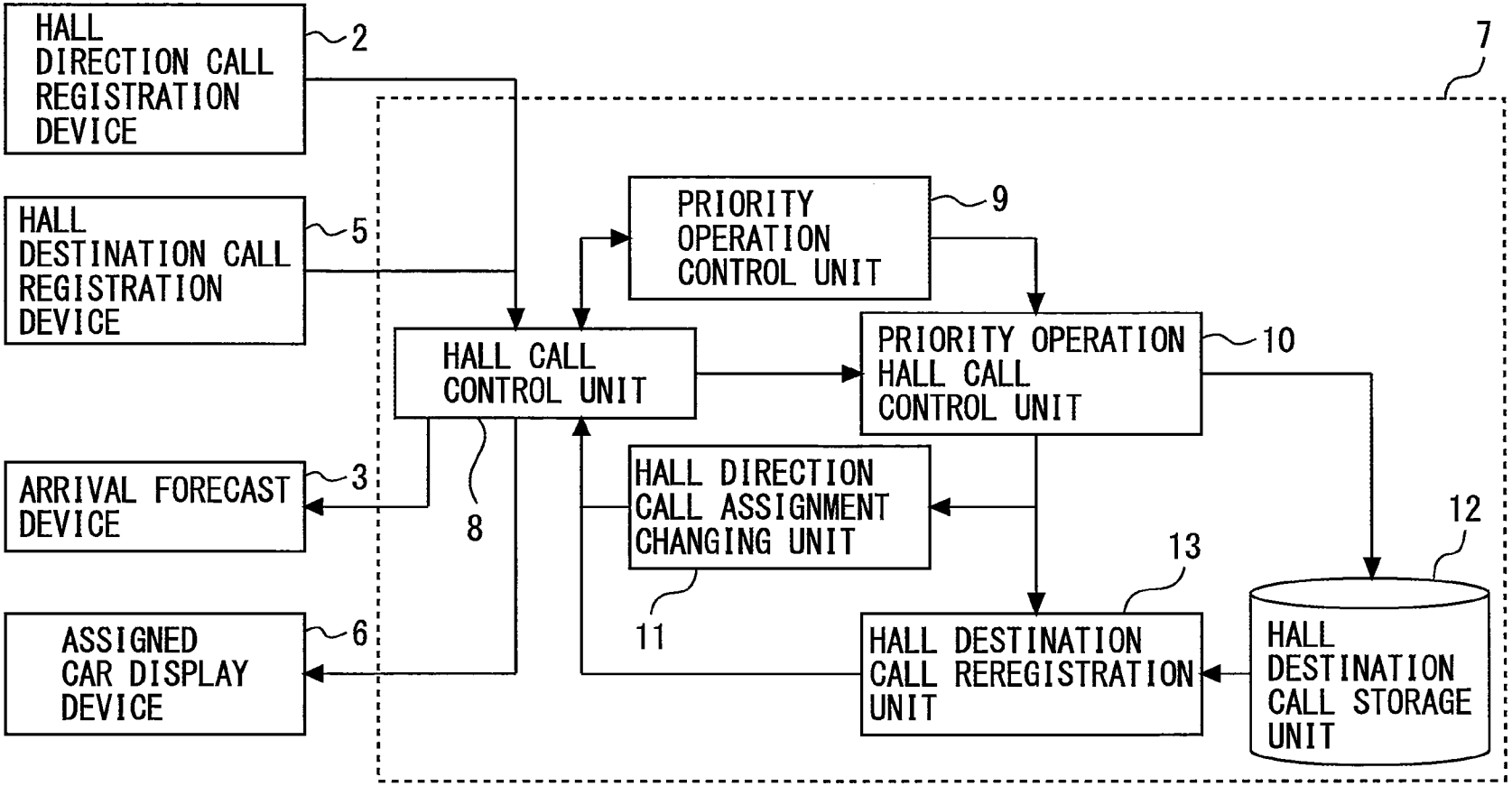
FIG. 3 is a configuration diagram of the elevator group management system according to Embodiment 1 of the present invention.

FIG. 3 is a configuration diagram of the elevator group management system according to Embodiment 1.

The elevator group management system includes a hall call registration device, a notification device, the hall destination call registration device 5, the assigned car display device 6, and a group management control device 7. FIG. 3 shows a configuration of the elevator group management system applied to a building including the first hall shown in FIG. 1 and the second hall shown in FIG. 2. In other words, FIG. 3 shows, as an example, a case where the hall direction call registration device 2 is provided as the hall call registration device and the arrival forecast device 3 is provided as the notification device. The group management control device 7 includes a hall call control unit 8, a priority operation control unit 9, a priority operation hall call control unit 10, a hall direction call assignment changing unit 11, a hall destination call storage unit 12, and a hall destination call reregistration unit 13.

When a hall direction call is registered using the hall direction call registration device 2, the hall call control unit 8 assigns an optimal car to the hall direction call. When a car is assigned to a hall direction call, the hall call control unit 8 transmits a lighting command signal to the arrival forecast device 3 corresponding to the car among the arrival forecast devices 3 of the hall at which the hall direction call registration device 2 operated in order to register the hall direction call is provided. The arrival forecast device 3 lights a display light based on the lighting command signal.

When a hall destination call is registered using the hall destination call registration device 5, the hall call control unit 8 assigns an optimal car to the hall destination call. When a car is assigned to a hall destination call, the hall call control unit 8 transmits an assignment signal to the assigned car display device 6 of the hall at which the hall destination call registration device 5 operated in order to register the hall destination call is provided. The assignment signal is, for example, a signal indicating a destination floor specified by the hall destination call and an assigned car which is assigned to the hall destination call. Based on the assignment signal, the assigned car display device 6 displays the destination floor and a car name of the assigned car only for a given length of time.

When a car is assigned to a hall call by the hall call control unit 8, the group management control device 7 causes the car to respond to a floor on which the hall call had been generated. For example, the group management control device 7 dispatches the assigned car to the floor on which the hall call had been generated by transmitting a signal to each car control device (not shown) which controls travel of each car.

In the elevator group management system, a priority operation may be performed. A priority operation is an operation method for preferentially transporting a specific user over general users. When a priority operation is being performed, for example, the group management control device 7 controls travel of a car so that general users do not get on the car from the moment a specific user gets on the car until the moment the specific user gets off. When a priority operation request is made, for example, the group management control device 7 dispatches a car to a priority operation standby floor by transmitting a signal to each car control device. In other words, for example, the group management control device 7 starts a priority operation via each car control device. A priority operation request refers to, for example, a specific operation being performed on the hall call registration device, the hall destination call registration device 5, or a dedicated operating unit provided at a hall. A priority operation standby floor refers to a boarding floor of a specific user in a priority operation. A priority car used in a priority operation is selected by the priority operation control unit 9.

The priority operation control unit 9 determines whether or not a priority operation request is made. When a priority operation request is made, the priority operation control unit 9 acquires a signal indicating a currently-occurring hall call from the hall call control unit 8. Based on the signal acquired from the hall call control unit 8, the priority operation control unit 9 determines whether or not there are cars not assigned to a hall call of which a boarding floor is a priority operation standby floor. When there are cars not assigned to a hall call of which a boarding floor is a priority operation standby floor, the priority operation control unit 9 selects a priority car from among the cars. When there are no cars not assigned to a hall call of which a boarding floor is a priority operation standby floor, the priority operation control unit 9 selects a priority car from among all cars. The priority operation control unit 9 transmits a signal indicating the car selected as a priority car to the hall call control unit 8 and the priority operation hall call control unit 10.

The priority operation hall call control unit 10 acquires a signal indicating a hall call to which the car selected as a priority car is already assigned from the hall call control unit 8. Based on the signal acquired from the hall call control unit 8, the priority operation hall call control unit 10 determines whether or not there are a hall direction call and a hall destination call to which a priority car is already assigned.

When there is a hall direction call to which a priority car is already assigned, the priority operation hall call control unit 10 transmits a signal indicating the hall direction call to the hall direction call assignment changing unit 11. Based on the signal, the hall direction call assignment changing unit 11 transmits an assignment change command signal to the hall call control unit 8. Based on the assignment change command signal, the hall call control unit 8 assigns another car to the hall direction call to which a priority car is already assigned. In this case, the hall call control unit 8 stops the transmission of a lighting command signal to the arrival forecast device 3 corresponding to the priority car and transmits a lighting command signal to the arrival forecast device 3 corresponding to the other car.

When there is a hall destination call to which a priority car is already assigned, the priority operation hall call control unit 10 transmits a signal indicating the hall destination call to the hall destination call storage unit 12. The hall destination call storage unit 12 stores the hall destination call indicated by the signal.

Based on the signal transmitted from the priority operation control unit 9, the hall call control unit 8 cancels the hall destination call to which the priority car is already assigned. In other words, the hall call control unit 8 cancels the hall destination call stored in the hall destination call storage unit 12. At this point, the car assigned to the hall direction call is already changed to a car which is not a priority car. While a signal indicating a priority car is being transmitted from the priority operation control unit 9, the hall call control unit 8 excludes the priority car from candidates of cars to be assigned to a hall direction call and a hall destination call.

The priority operation control unit 9 determines whether or not a priority operation is completed. Once the priority operation is completed, the priority operation control unit 9 no longer transmits a signal indicating a priority car. When a signal indicating a priority car is no longer transmitted from the priority operation control unit 9, the priority operation hall call control unit 10 transmits a reregistration command signal to the hall destination call reregistration unit 13. The hall destination call reregistration unit 13 acquires a signal indicating a hall destination call stored in the hall destination call storage unit 12. The hall destination call reregistration unit 13 transmits the signal indicating the hall destination call to the hall call control unit 8. Based on the signal transmitted from the hall destination call reregistration unit 13, the hall call control unit 8 reassigns a car used as a priority car to the hall destination call. In other words, after the priority operation is completed, the hall destination call reregistration unit 13 reregisters the hall destination call to which the car selected as a priority car had already been assigned before performing the priority operation.

Figure 4:
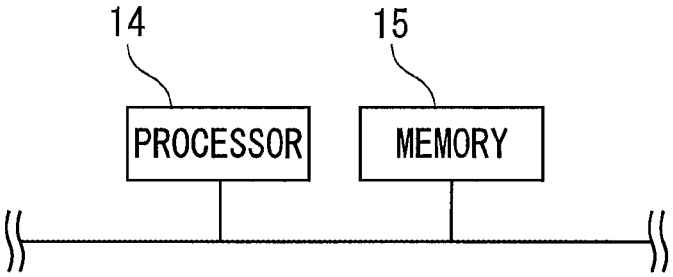
FIG. 4 is a hardware configuration diagram of an elevator group management device according to Embodiment 1 of the present invention.

FIG. 4 is a hardware configuration diagram of a group management control device according to Embodiment 1. The group management control device 7 includes a processor 14 and a memory 15. Functions of the group management control device 7 are realized when the processor 14 executes a program stored in the memory 15. Alternatively, the functions of the group management control device 7 may be realized by having a plurality of processors and a plurality of memories cooperate with each other.

FIG. 5 is a flowchart showing operations of the elevator group management system according to Embodiment 1.

Hereinafter, an example of operations of the elevator group management system will be described with reference to FIG. 5.

The priority operation control unit 9 determines whether or not a priority operation request is made (step S101). When it is determined in step S101 that a priority operation request is not made, the priority operation control unit 9 repeats the process of step S101. When it is determined in step S101 that a priority operation request is made, the priority operation control unit 9 determines whether or not there are cars not assigned to a hall call of which a boarding floor is a priority operation standby floor (step S102).

When it is determined in step S102 that there are cars not assigned to a hall call of which a boarding floor is a priority operation standby floor, the elevator group management system performs a process of step S103. In step S103, the priority operation control unit 9 selects a priority car from among cars not assigned to a hall call of which a boarding floor is a priority operation standby floor.

When it is determined in step S102 that there are no cars not assigned to a hall call of which a boarding floor is a priority operation standby floor, the elevator group management system performs a process of step S104. In step S104, the priority operation control unit 9 selects a priority car from among all cars.

Following step S103 or step S104, the elevator group management system performs a process of step S105. In step S105, the priority operation hall call control unit 10 determines whether or not there is a hall direction call to which a priority car is already assigned. When it is determined in step S105 that there is a hall direction call to which a priority car is already assigned, based on an assignment change command signal, the hall call control unit 8 assigns another car to the hall direction call to which the priority car is already assigned (step S106). Following step S106, the elevator group management system performs a process of step S107. When it is determined in step S105 that there is no hall direction call to which a priority car is already assigned, the elevator group management system also performs the process of step S107.

In step S107, the priority operation hall call control unit 10 determines whether or not there is a hall destination call to which a priority car is already assigned. When it is determined in step S107 that there is a hall destination call to which a priority car is already assigned, the hall destination call storage unit 12 stores the hall destination call to which a priority car is already assigned (step S108). Following step S108, the hall call control unit 8 cancels the hall destination call to which a priority car is already assigned (step S109). Following step S109, the elevator group management system performs a process of step S110. When it is determined in step S107 that there is no hall destination call to which a priority car is already assigned, the elevator group management system also performs the process of step S110.

In step S110, the group management control device 7 starts a priority operation. Following step S110, the priority operation control unit 9 determines whether or not the priority operation is completed (step S111). When it is determined in step S111 that the priority operation is not completed, the priority operation control unit 9 repeats the process of step S111.

When it is determined in step S111 that the priority operation is completed, the hall destination call reregistration unit 13 determines whether or not there is a hall destination call stored in the hall destination call storage unit 12 (step S112). When it is determined in step S112 that there is a stored hall destination call, the elevator group management system performs a process of step S113. When it is determined in step S112 that there is no stored hall destination call, the elevator group management system ends the process.

In step S113, the hall call control unit 8 reassigns a car used as a priority car to the stored hall destination call. In step S113, the hall destination call storage unit 12 deletes the stored hall destination call.

Figure 6:
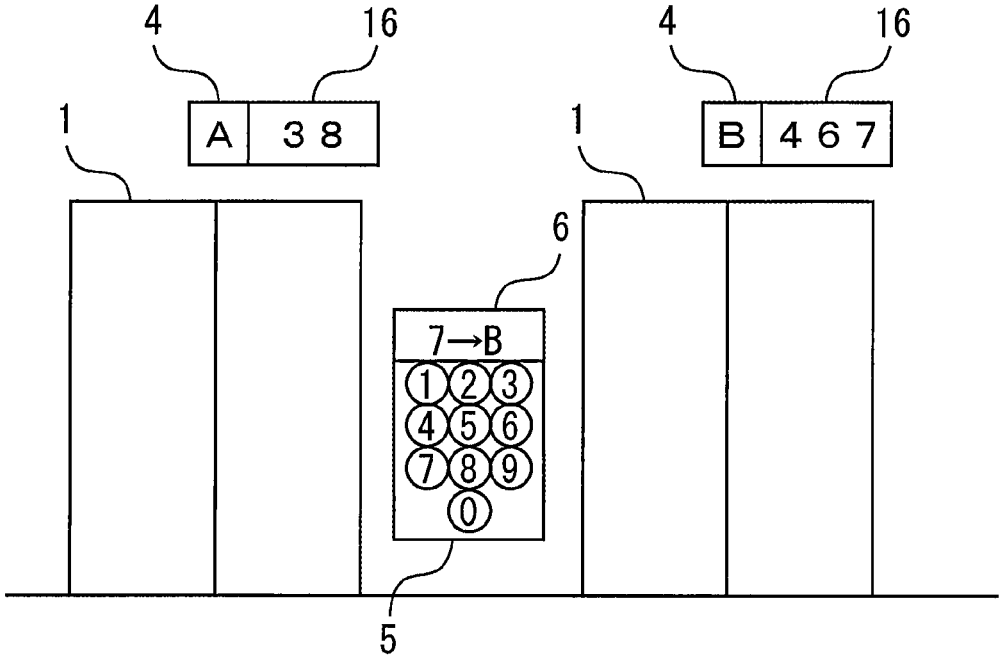
FIG. 6 is a front view showing another example of a first hall provided in a building to which the elevator group management system according to Embodiment 1 of the present invention is applied.
Figure 7:
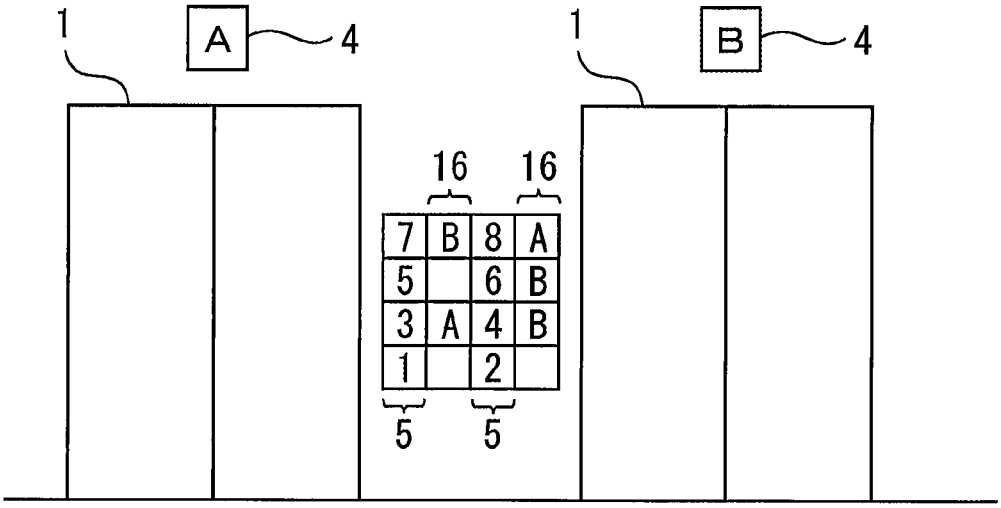
FIG. 7 is a front view showing another example of a first hall provided in a building to which the elevator group management system according to Embodiment 1 of the present invention is applied.

FIGS. 6 and 7 are front views showing other examples of a first hall provided in a building to which the elevator group management system according to Embodiment 1 is applied. The first halls shown in FIGS. 6 and 7 are provided with the car name display 4, the hall destination call registration device 5, and a destination floor display device 16. The destination floor display device 16 constantly and continues to display a correspondence between a destination floor specified by a hall destination call and a car to stop at the destination floor. In other words, FIGS. 6 and 7 show examples of a case where the hall destination call registration device 5 is provided as a hall call registration device and the destination floor display device 16 is provided as a notification device.

The destination floor display device 16 shown in FIG. 6 is arranged near the car name display 4. In other words, the destination floor display device 16 shown in FIG. 6 is provided together with the car name display 4 in correspondence with each elevation path and each car.

When a destination floor is input using the hall destination call registration device 5 and a corresponding car is used to travel to the destination floor, the destination floor display device 16 shown in FIG. 6 starts displaying information indicating the destination floor. After the corresponding car responds to the first hall, the destination floor display device 16 shown in FIG. 6 ends the display of information indicating the destination floor of the car. FIG. 6 shows an example of a state where the car A is assigned to hall destination calls of which the destination floors are the 3rd floor and the 8th floor and the car B is assigned to hall destination calls of which the destination floors are the 4th floor, the 6th floor, and the 7th floor.

The hall destination call registration device 5 shown in FIG. 7 includes, for example, buttons corresponding to the respective floors of the building and the like. The destination floor display device 16 shown in FIG. 7 is arranged near the hall destination call registration device 5. For example, the destination floor display device 16 shown in FIG. 7 is provided in correspondence with each button of the hall destination call registration device 5. Alternatively, for example, the destination floor display device 16 shown in FIG. 7 may be formed as a device integrated with the hall destination call registration device 5.

When a destination floor is input using a corresponding button of the hall destination call registration device 5, the destination floor display device 16 shown in FIG. 7 starts displaying information indicating a car to be used to travel to the destination floor. Information displayed by the destination floor display device 16 shown in FIG. 7 corresponds to, for example, the characters, the symbols, and the like which are displayed by the car name display 4. After the car indicated by the displayed information responds to the first hall, the destination floor display device 16 shown in FIG. 7 ends the display of the information indicating the car. FIG. 7 shows an example of a state where the car A is assigned to hall destination calls of which the destination floors are the 3rd floor and the 8th floor and the car B is assigned to hall destination calls of which the destination floors are the 4th floor, the 6th floor, and the 7th floor.

With respect to a hall destination call which is registered using the hall destination call registration devices 5 shown in FIGS. 6 and 7 and to which a priority car is already assigned, the group management control device 7 may assign another car. In this case, the destination floor display device 16 ends the display of the correspondence between the destination floor specified by the hall destination call and the priority car and, at the same time, starts display of a correspondence between the destination floor specified by the hall destination call and the other car. In other words, the destination floor display device 16 continues to display an elevation path through which a car currently being assigned to the hall destination call registered using the hall call registration device travels.

In Embodiment 1, a first hall for getting onto and getting off a plurality of cars which travel through different elevation paths is provided with a hall call registration device for registering a hall call. A second hall for getting onto and getting off the plurality of cars is provided with the hall destination call registration device 5 for registering a hall destination call among hall calls. The first hall is provided with a notification device which indicates an elevation path through which a car currently being assigned to a hall call registered using the hall call registration device travels. The second hall is provided with the assigned car display device 6 which displays, when a hall destination call is registered using the hall destination call registration device 5, an elevation path through which a car having been assigned to the hall destination call travels, only for a given length of time. The group management control device 7 assigns one of the plurality of cars to hall calls registered using the hall call registration device and the hall destination call registration device 5 and selects a priority car to be used in a priority operation from among the plurality of cars. When a priority car is selected from among the plurality of cars, the group management control device 7 assigns a car which differs from the priority car to a hall call which is registered using the hall call registration device at the first hall and to which the priority car is already assigned. When a priority car is selected from among the plurality of cars, with respect to a hall destination call which is registered using the hall destination call registration device 5 at the second hall and to which the priority car is already assigned, the group management control device 7 performs a priority operation using the priority car and subsequently causes the car used as the priority car to respond to the hall destination call. In other words, when a change in car assignment with respect to a hall call can be notified to a general user standing by at a hall, the elevator group management system assigns another car to a hall call to which the priority car is already assigned. In this case, the general user can be made aware of the assignment change by the notification device and can get on another car without having to stand by for a long period of time. In addition, when a change in car assignment with respect to a hall destination call cannot be notified to a general user standing by at a hall, the elevator group management system causes, after the priority operation ends, the car used as the priority car to respond to the hall destination call to which the priority car had already been assigned. In this case, a general user can get on a car used as a priority car without having to reregister a hall destination call. As a result, according to Embodiment 1, a decline in convenience of general users caused by performing a priority operation can be suppressed.

In Embodiment 1, for example, the hall call registration device is used to register a hall direction call among the hall calls. The notification device is, for example, the arrival forecast device 3 which indicates an elevation path through which a car currently being assigned to a hall direction call registered using the hall call registration device travels. When a priority car is selected from among the plurality of cars, the group management control device 7 assigns a car which differs from the priority car to a hall direction call which is registered using the hall call registration device and to which the priority car is already assigned. In other words, when the arrival forecast device 3 is provided at a hall, since a change in car assignment can be notified to a general user, the elevator group management system assigns another car to a hall direction call to which the priority car is already assigned. As a result, a decline in convenience of general users caused by performing a priority operation can be suppressed.

In Embodiment 1, for example, the hall call registration device is used to register a hall destination call among the hall calls. The notification device is, for example, the destination floor display device 16 which continues to display an elevation path through which a car being assigned to a hall destination call registered using the hall call registration device travels. When a priority car is selected from among the plurality of cars, the group management control device 7 assigns a car which differs from the priority car to a hall destination call which is registered using the hall call registration device and to which the priority car is already assigned. In other words, when the destination floor display device 16 is provided at a hall, since a change in car assignment can be notified to a general user, the elevator group management system assigns another car to a hall direction call to which the priority car is already assigned. As a result, a decline in convenience of general users caused by performing a priority operation can be suppressed.

In Embodiment 1, the group management control device 7 includes the hall call control unit 8, the hall destination call storage unit 12, and the hall destination call reregistration unit 13. The hall destination call storage unit 12 stores a hall destination call which is registered using the hall destination call registration device 5 at the second hall and to which a priority car selected from among a plurality of cars is already assigned before performing a priority operation. The hall call control unit 8 cancels the hall destination call stored in the hall destination call storage unit 12 before the priority operation is performed. The hall destination call reregistration unit 13 reregisters the hall destination call stored in the hall destination call storage unit 12 after the priority operation is performed. In other words, when a change in car assignment with respect to a hall destination call cannot be notified to a general user standing by at a hall, the elevator group management system performs a priority operation by delaying a response to the hall destination call without changing a car to be assigned to the hall destination call. In this case, a general user can get on a priority car without having to reregister a hall destination call. As a result, a decline in convenience of general users caused by performing a priority operation can be suppressed.

In Embodiment 1, for example, the group management control device 7 selects a priority car from among cars not assigned to a hall call of which a boarding floor is a priority operation standby floor in a plurality of cars. In this case, a general user standing by to get on the car selected as the priority car is not present at a hall of the priority operation standby floor. Therefore, general users can be prevented from experiencing discomfort due to ceding a car to a specific user. In addition, since the presence of a specific user is not unnecessarily notified to other users, security of a priority operation can be improved.

INDUSTRIAL APPLICABILITY

The elevator group management system according to the present invention can be applied to buildings provided with a plurality of cars.

REFERENCE SIGNS LIST

1 Hall door
2 Hall direction call registration device
3 Arrival forecast device
4 Car name display
5 Hall destination call registration device
6 Assigned car display device
7 Group management control device
8 Hall call control unit
9 Priority operation control unit
10 Priority operation hall call control unit
11 Hall direction call assignment changing unit
12 Hall destination call storage unit
13 Hall destination call reregistration unit
14 Processor
15 Memory
16 Destination floor display device

The invention claimed is:

1. An elevator group management system, comprising:

a hall call registration device which is provided at a first hall for getting onto or getting off a plurality of cars that travel through different elevation paths and which is used to register hall calls;

a hall destination call registration device which is provided at a second hall for getting onto or getting off the plurality of cars and which is used to register a hall destination call among the hall calls;

a notification device which is provided at the first hall and which indicates an elevation path through which a car currently being assigned to a hall call registered using the hall call registration device travels;

an assigned car display device which is provided at the second hall and which displays, when a hall destination call is registered using the hall destination call registration device, an elevation path through which a car having been assigned to the hall destination call travels, only for a given length of time; and a group management control device which assigns one of the plurality of cars to a hall call registered using the hall call registration device and the hall destination call registration device and which selects a priority car to be used in a priority operation from among the plurality of cars when a priority operation request is made, wherein when a priority car is selected from among the plurality of cars, the group management control device assigns a car that differs from the priority car to a hall call which is registered using the hall call registration device and to which the priority car is already assigned, and does not perform a change in assignment to a car that differs from the priority car to a hall destination call which is registered using the hall destination call registration device and to which the priority car is already assigned.

2. The elevator group management system according to claim 1, wherein the hall call registration device is used to register a hall direction call among the hall calls, the notification device is an arrival forecast device which indicates an elevation path through which a car assigned to a hall direction call registered using the hall call registration device travels, and when a priority car is selected from among the plurality of cars, the group management control device assigns a car which differs from the priority car to a hall direction call which is registered using the hall call registration device and to which the priority car is already assigned.

3. The elevator group management system according to claim 1, wherein the hall call registration device is used to register a hall destination call among the hall calls, the notification device is a destination floor display device which continues to display an elevation path through which a car assigned to a ball destination call registered using the hall call registration device travels, and when a priority car is selected from among the plurality of cars, the group management control device assigns a car which differs from the priority car to a hall destination call which is registered using the hall call registration device and to which the priority car is already assigned.

4. The elevator group management system according to claim 1, wherein the group management control device includes:

a hall destination call storage unit which stores a hall destination call which is registered using the hall destination call registration device and to which a priority car selected from among the plurality of cars is already assigned before a priority operation is performed;

a hall call control unit which cancels a hall destination call stored in the hall destination call storage unit before the priority operation is performed; and a hall destination call reregistration unit which reregisters a hall destination call stored in the hall destination call storage unit after the priority operation is performed.

5. The elevator group management system according to claim 1, wherein the group management control device selects a priority car from among cars not assigned to a hall call of which a boarding floor is a priority operation standby floor among the plurality of cars.

6. The elevator group management system according to claim 1, wherein when a priority car is selected from among the plurality of cars, the group management control device performs a priority operation using the priority car and subsequently causes the priority car to respond to a hall destination call which is registered using the hall destination call registration device and to which the priority car is already assigned.

* * * * *